US009172169B2

(12) United States Patent
Hagio et al.

(10) Patent No.: US 9,172,169 B2
(45) Date of Patent: Oct. 27, 2015

(54) TERMINAL ARRANGEMENT DEVICE

(71) Applicant: DENSO CORPORATION, Kariya, Aichi-pref. (JP)

(72) Inventors: Hirofumi Hagio, Handa (JP); Takehito Mizunuma, Chiryu (JP); Takamitsu Kubota, Chiryu (JP)

(73) Assignee: DENSO CORPORATION, Kariya (JP)

( * ) Notice: Subject to any disclaimer, the term of this patent is extended or adjusted under 35 U.S.C. 154(b) by 8 days.

(21) Appl. No.: 14/088,020

(22) Filed: Nov. 22, 2013

(65) Prior Publication Data

US 2014/0148066 A1 May 29, 2014

(30) Foreign Application Priority Data

Nov. 28, 2012 (JP) ..... 2012-259800

(51) Int. Cl.
*H01R 13/11* (2006.01)

(52) U.S. Cl.
CPC ..... *H01R 13/113* (2013.01); *H01R 13/112* (2013.01)

(58) Field of Classification Search
CPC ..... H01R 13/113
See application file for complete search history.

(56) References Cited

U.S. PATENT DOCUMENTS

| | | | | |
|---|---|---|---|---|
| 5,147,218 | A | 9/1992 | Matthews et al. | |
| 5,749,755 | A * | 5/1998 | Genta et al. | 439/856 |
| 6,071,152 | A * | 6/2000 | Achammer et al. | 439/733.1 |
| 6,224,428 | B1 * | 5/2001 | Chen et al. | 439/694 |
| 6,224,432 | B1 * | 5/2001 | Billman | 439/856 |
| 2002/0130656 | A1 * | 9/2002 | Hagio et al. | 324/207.2 |
| 2005/0014423 | A1 * | 1/2005 | Roepke | 439/856 |
| 2010/0190362 | A1 * | 7/2010 | Wallrafen | 439/81 |
| 2012/0329304 | A1 * | 12/2012 | Lopes et al. | 439/345 |
| 2013/0244504 | A1 * | 9/2013 | Ogura | 439/759 |
| 2014/0148066 | A1 * | 5/2014 | Hagio et al. | 439/834 |

FOREIGN PATENT DOCUMENTS

| | | |
|---|---|---|
| JP | 61-116778 | 6/1986 |
| JP | 4-131868 | 12/1992 |
| JP | 2005-108581 | 4/2005 |

OTHER PUBLICATIONS

English translation of Office Action (4 pages) dated Aug. 23, 2014, issued in corresponding Korean Application No. 10-2013-143905.
Office Action (2 pages) dated Oct. 28, 2014, issued in corresponding Japanese Application No. 2012-259800 and English translation (2 pages).

* cited by examiner

*Primary Examiner* — James Harvey
(74) *Attorney, Agent, or Firm* — Nixon & Vanderhye P.C.

(57) ABSTRACT

A terminal arrangement device electrically connects an electric device, which is received in a housing, to an external device, and includes a first connecting terminal fixed to the housing. The first connecting terminal has a first supporting portion and a second supporting portion which are elastically deformable such that an output terminal of the electric device is supported between the first supporting portion and the second supporting portion. The first supporting portion has a flexural rigidity which is different from a flexural rigidity of the second supporting portion.

16 Claims, 6 Drawing Sheets

TERMINAL ARRANGEMENT DEVICE

CROSS REFERENCE TO RELATED APPLICATION

This application is based on Japanese Patent Application No. 2012-259800 filed on Nov. 28, 2012, the disclosure of which is incorporated herein by reference in its entirety.

TECHNICAL FIELD

The present disclosure relates to a terminal arrangement device which electrically connects an electric device to an external device.

BACKGROUND

JP-H06-507043A (U.S. Pat. No. 5,147,218) discloses a fork-shaped connecting terminal which electrically connects an electric device with a connector. The fork-shaped connecting terminal has a tip portion separated in two in a width direction, and is commonly used due to the simple structure.

Vehicles are recently downsized and sophisticated, so an in-vehicle device is also required to be downsized, lighter in weight, sophisticated, and to have high quality. Further, producing cost of the in-vehicle device is required to be reduced.

SUMMARY

It is an objective of the present disclosure to provide a terminal arrangement device which allows an electric device to be downsized.

According to the present disclosure, there is provided a terminal arrangement device that electrically connects an electric device which is received in a housing to an external device. The terminal arrangement device includes a connecting terminal fixed to the housing. The connecting terminal has a first supporting portion and a second supporting portion which are elastically deformable such that an output terminal of the electric device is supported between the first supporting portion and the second supporting portion. The first supporting portion has a flexural rigidity which is different from a flexural rigidity of the second supporting portion.

Accordingly, the connecting terminal supports the output terminal of the electric device in a manner that only one of the first supporting portion and the second supporting portion is elastically deformed due to the difference in the flexural rigidity. Thus, the terminal arrangement device and the electric device are prevented from having a short circuit by simply adjusting the arrangement and the orientation of the connecting terminal. Further, the output terminal is securely supported between the first supporting portion and the second supporting portion, so a predetermined electrical connection strength can be secured between the output terminal and the connecting terminal while a clearance between the connecting terminal and the electric device can be set the minimum. Furthermore, the terminal arrangement device is downsized.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiments of the present disclosure will be described hereafter referring to drawings. In the embodiments, a part that corresponds to a matter described in a preceding embodiment may be assigned with the same reference number, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 1:
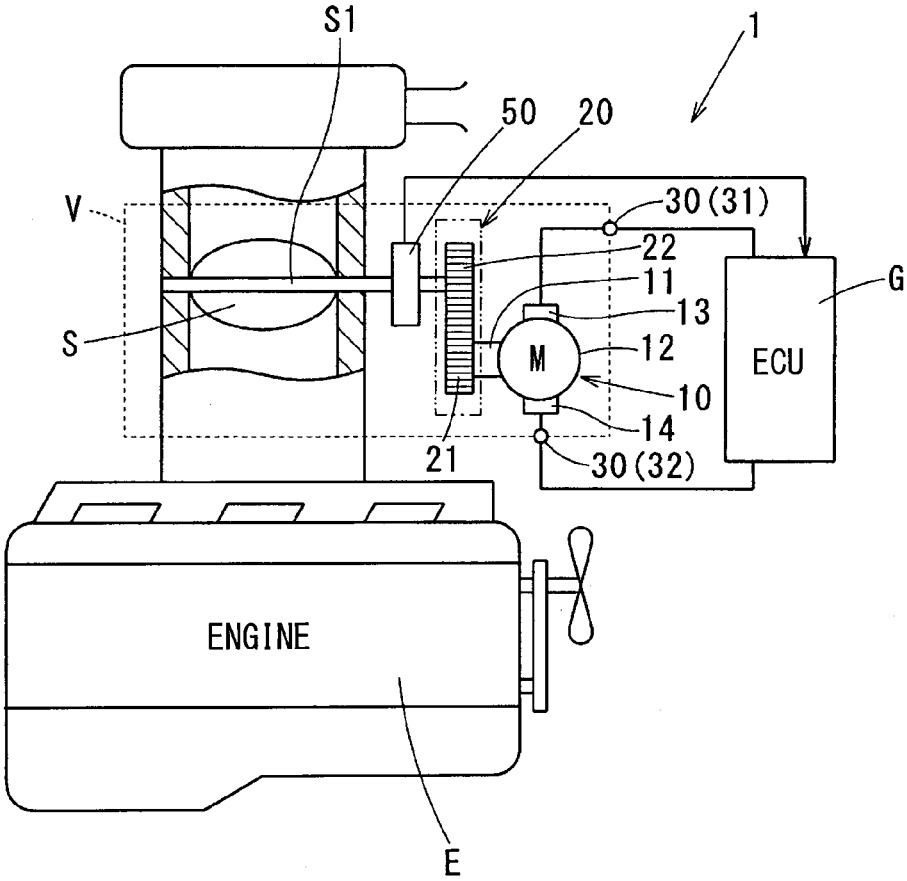
FIG. 1 is a schematic view illustrating an electronic throttle device for an internal combustion engine.

An electronic throttle device 1, which is an example of an electronic apparatus, has an actuating motor 10, which is an example of an electric device. The actuating motor 10 opens or closes a throttle valve S for an internal combustion engine (i.e., engine) E. A basic structure of the electronic throttle device 1 will be described with reference to FIGS. 1 and 2.

The electronic throttle device 1 has a valve device V and an electronic control unit (ECU) G. The valve device V includes the throttle valve S which controls an intake air amount drawn into the engine E. The ECU G controls the valve device V.

The valve device V has the actuating motor 10, a gear reducer 20, a terminal arrangement device 30, a housing 40, and a throttle position sensor 50. The actuating motor 10 actuates the valve device V. The gear reducer 20 reduces rotating speed of the actuating motor 10 and transmits a torque to the throttle valve S. The terminal arrangement device 30 electrically connects the actuating motor 10 to the ECU G. The housing 40 has the actuating motor 10, the gear reducer 20 and the terminal arrangement device 30 therein. The throttle position sensor 50 converts an opening degree of the throttle valve S to an electric signal.

The actuating motor 10 is, for example, a direct-current (DC) brush motor and is fixed such that the actuating motor 10 is unable to move relative to the housing 40. The actuating motor 10 has an output shaft 11 and a motor case 12. An end portion of the output shaft 11 is exposed from the motor case 12 to the gear reducer 20. The gear reducer 20 has a small gear 21 and a large gear 22. The small gear 21 is smaller than the large gear 22. The small gear 21 is fixed to the output shaft 11.

The small gear 21 and the large gear 22 construct a well-known gear reducing structure. The actuating motor 10 and a rotating shaft S1 of the throttle valve S are connected with each other via the gear reducing structure. The rotating speed of the actuating motor 10 is reduced by the gear reducing structure, and the reduced rotating speed of the actuating motor 10 is transmitted to the throttle valve S.

The actuating motor 10 further has a first output terminal 13 and a second output terminal 14 (e.g., a pair of output terminals) connected with the motor case 12. The first output terminal 13 and the second output terminal 14 are not equal with each other in electric potential. For example, an electric potential of the first output terminal 13 is higher than an electric potential of the second output terminal 14. Both the first output terminal 13 and the second output terminal 14 are electrically connected to the ECU G via the terminal arrangement device 30, and an actuating signal is fed into the first output terminal 13 and the second output terminal 14 from the ECU G.

The ECU G applies a signal, which includes instruction about a required rotation direction for the throttle valve S, to the actuating motor 10 to control operating conditions of the engine E. Based on the signal, the actuating motor 10 actuates the throttle valve S to rotate in an opening direction or in a closing direction.

The first output terminal 13 and the second output terminal 14 are made of an electrically conducting material having a flat plate shape such as copper plate or aluminum plate. Each of the first output terminal 13 and the second output terminal 14 has a rectangular shape in cross-section.

The motor case 12 has an extending portion 12*a* which is relatively small in diameter with respect to a main portion of the motor case 12. For example, the extending portion 12*a* may correspond to a bearing portion. The first output terminal 13 and the second output terminal 14 extend from an end face of the motor case 12 in an axial direction, and oppose each other through the extending portion 12*a* in the thickness direction. The first output terminal 13 and the second output terminal 14 are arranged such that the extending portion 12*a* is located between the first output terminal 13 and the second output terminal 14.

The motor case 12 is made of a flat metal plate (electrically conducting material) such as iron plate. The first output terminal 13 and the second output terminal 14 are attached to the motor case 12 through an electrically insulating material such as rubber.

Figure 3A:
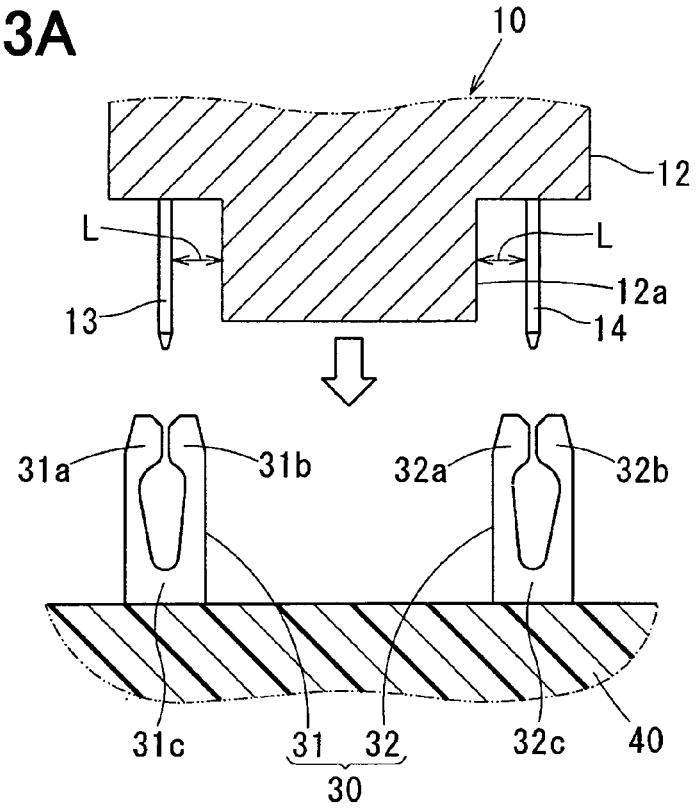
FIG. 3A is a schematic cross-sectional view illustrating the terminal arrangement device according to the first embodiment before an output terminal is press-fitted to the terminal arrangement device.

As shown in FIG. 3A, each of the first output terminal 13 and the second output terminal 14 is located to have a distance L from the extending portion 12*a*, before the first output terminal 13 and the second output terminal 14 are assembled to the terminal arrangement device 30. A value of the distance L is determined to be the minimum by considering the position relationship relative to the terminal arrangement device 30.

The terminal arrangement device 30 has a first connecting terminal 31 and a second connecting terminal 32 (e.g., a pair of connecting terminals). The first connecting terminal 31 and the second connecting terminal 32 are made of an electrically conducting material having a flat plate shape such as copper plate or aluminum plate. Each of the first connecting terminal 31 and the second connecting terminal 32 has a rectangular shape in cross-section.

The first connecting terminal 31 and the second connecting terminal 32 are fixed to the housing 40 to be arranged such that the first connecting terminal 31 faces the first output terminal 13 and that the second connecting terminal 32 faces the second output terminal 14. The first connecting terminal 31 and the second connecting terminal 32 are separated enough from each other, and the extending portion 12*a* is located between the first connecting terminal 31 and the second connecting terminal 32.

Further, the thickness direction of the first connecting terminal 31 is perpendicular to the thickness direction of the first output terminal 13, and the thickness direction of the second connecting terminal 32 is perpendicular to the thickness direction of the second output terminal 14.

The first connecting terminal 31 and the second connecting terminal 32 will be described in detail with reference to FIGS. 3A, 3B and 4.

Each of the first connecting terminal 31 and the second connecting terminal 32 is a fork-shaped terminal. Specifically, the first connecting terminal 31 has a first supporting portion 31*a* and a second supporting portion 31*b*, which extend with curved shape from a base portion 31*c* in the separated state from each other. The first supporting portion 31*a* and the second supporting portion 31*b* are elastically deformable in a manner that a distance between the first supporting portion 31*a* and the second supporting portion 31*b* is increased when the first connecting terminal 13 is fitted with the clearance between the first supporting portion 31*a* and the second supporting portion 31*b*.

Similarly, the second connecting terminal 32 has a first supporting portion 32*b* and a second supporting portion 32*a*, which extend with curved shape from a base portion 32*c* in the separated from each other. The second supporting portion 32*a* and the first supporting portion 32*b* are elastically deformable in a manner that a distance between the second supporting portion 32*a* and the first supporting portion 32*b* is increased when the second connecting terminal 14 is fitted with the clearance between the second supporting portion 32*a* and the first supporting portion 32*b*.

For example, the first connecting terminal 31 and the second connecting terminal 32 are made of an electrically conducting plate having a constant thickness by cutting-work. As shown in FIG. 3B, the second supporting portion 31*b* is distanced from the actuating motor 10 by a distance L1 which is shorter than a distance between the actuating motor 10 and the first supporting portion 31*a*. Similarly, the second supporting portion 32*a* is distanced from the actuating motor 10 by the distance L1 which is shorter than a distance between the actuating motor 10 and the first supporting portion 32*b*.

Figure 4:
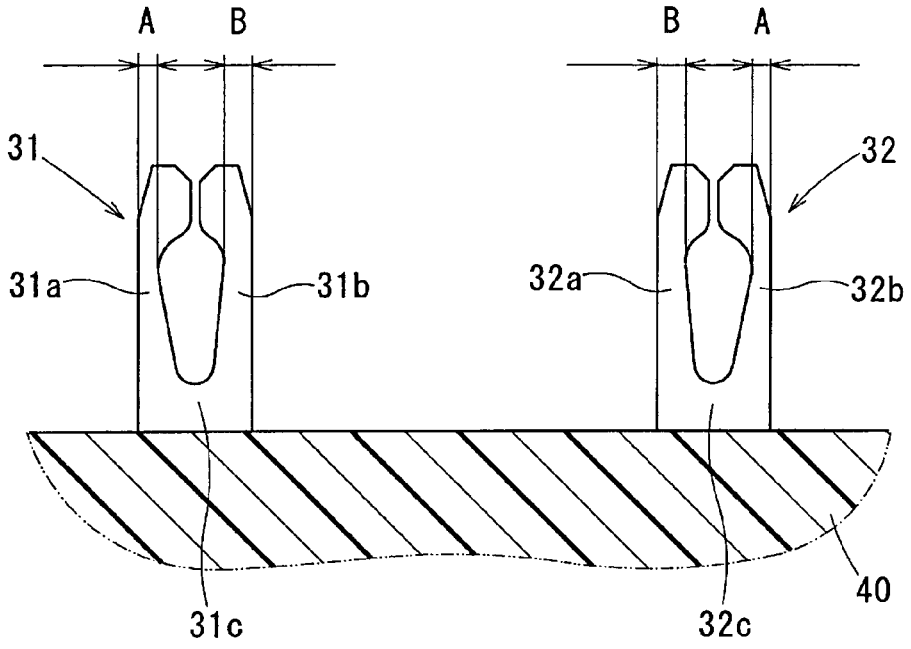
FIG. 4 is a front view illustrating the terminal arrangement device according to the first embodiment.

As shown in FIG. 4, a width B of the second supporting portion 31*b*, 32*a* is larger than a width A of the first supporting portion 31*a*, 32*b*, so a flexural rigidity of the second supporting portion 31*b*, 32*a* is larger than a flexural rigidity of the first supporting portion 31*a*, 32*b*. That is, a relationship between the width A and the width B is shown as A<B. The flexural rigidity may be referred as an elastic deformation force.

As shown in an arrow direction of FIG. 3A, the first output terminal 13 is fitted between the first supporting portion 31*a* and the second supporting portion 31*b*. In the same manner, the second output terminal 14 is fitted between the second supporting portion 32*a* and the first supporting portion 32*b*. Thus, the first connecting terminal 31 and the second connecting terminal 32 are electrically connected with the first output terminal 13 and the second output terminal 14, respectively.

The clearance between the first supporting portion 31*a* and the second supporting portion 31*b* is increased by the first output terminal 13, and the first output terminal 13 is tightly supported by the first supporting portion 31*a* and the second supporting portion 31*b* which are elastically deformed. Similarly, the clearance between the second supporting portion 32*a* and the first supporting portion 32*b* is increased by the second output terminal 14, and the second output terminal 14 is tightly supported by the second supporting portion 32*a* and the first supporting portion 32*b* which are elastically deformed.

The flexural rigidity of the first supporting portion 31*a*, 32*b* is smaller than the flexural rigidity of the second supporting portion 31*b*, 32*a*. Thus, the first supporting portion 31*a*, 32*b* is elastically deformed easily compared with the second supporting portion 31*b*, 32*a*. On the other hand, the second supporting portion 31*b*, 32*a* is elastically deformed slightly. When the first output terminal 13 is tightly supported by the first supporting portion 31*a* and the second supporting portion 31*b*, the elastic deformation of the first supporting portion 31*a* is larger than that of the second supporting portion 31*b*. When the second output terminal 14 is tightly supported by the first supporting portion 32*b* and the second supporting portion 32*a*, the elastic deformation of the first supporting portion 32*b* is larger than that of the second supporting portion 32*a*.

Figure 3B:
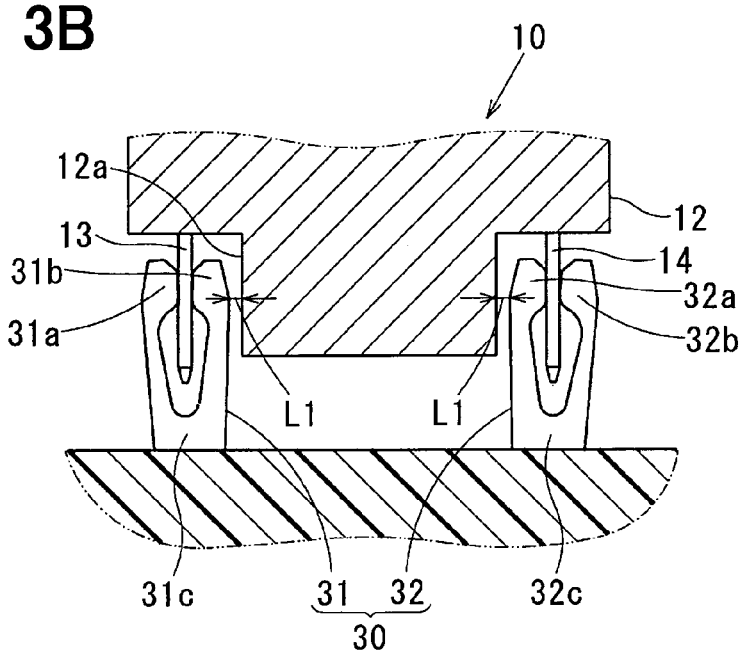
FIG. 3B is a schematic cross-sectional view illustrating the terminal arrangement device according to the first embodiment after the output terminal is press-fitted to the terminal arrangement device.

Therefore, as shown in FIG. 3B, the extending portion 12*a* of the motor case 12 of the actuating motor 10 is secured to have the distance L1 from each of the second supporting portion 31*b* of the first connecting terminal 31 and the second supporting portion 32*a* of the second connecting terminal 32.

The first output terminal 13 and the second output terminal 14 are not limited to be press-fitted to the first connecting terminal 31 and the second connecting terminal 32, respectively, by using the elastic force. For example, the first output terminal 13 and the second output terminal 14 may be temporarily connected with the first connecting terminal 31 and the second connecting terminal 32, respectively, by the elastic force, and may be connected finally by soldering. In this case, the first supporting portion 31*a*, 32*b* and the second supporting portion 31*b*, 32*a* are plastically deformed. Even in such a case, the plastic deformation of the second supporting portion 31*b*, 32*a* is much smaller than that of the first supporting portion 31*a*, 32*b*, so the extending portion 12*a* can be sufficiently distanced from each of the first connecting terminal 31 and the second connecting terminal 32 by the distance L1.

The housing 40 is comprised of a molded component made of a general heat-resistance resin such as polybutylene terephthalate resin, and components such as the terminal arrangement device 30 are disposed in the housing 40 in advance when the housing 40 is molded.

Figure 2:
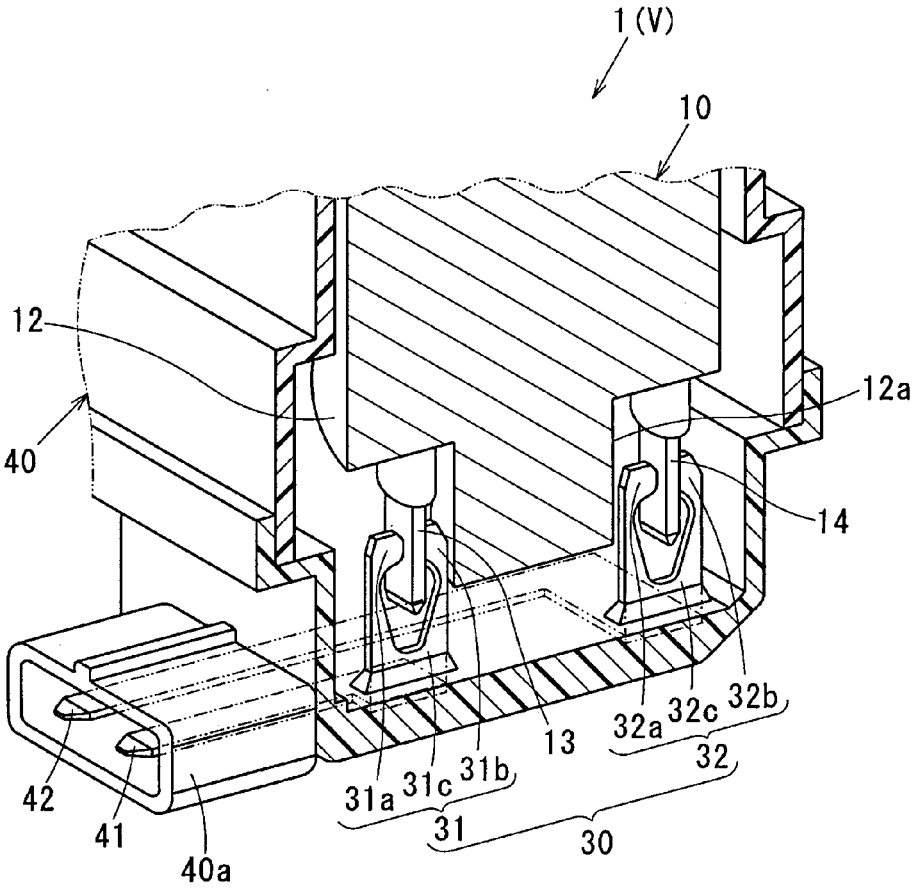
FIG. 2 is a perspective cross-sectional view illustrating the electronic throttle device which employs a terminal arrangement device according to a first embodiment.

As shown in FIG. 2, the housing 40 is molded to integrally have a connector 40*a*. The connector 40*a* is electrically connected with a signal providing terminal of the ECU G (external device). The connector 40*a* has a first terminal 41 and a second terminal 42 made of an electrically conductive plate. The first connecting terminal 31 and the second connecting terminal 32 are also made of an electrically conductive plate. The first terminal 41 and the first connecting terminal 31 may be integrally made of one electrically-conductive plate by insert-molding, and the second terminal 42 and the second connecting terminal 32 may be integrally made of one electrically-conductive plate by insert-molding.

Therefore, the first terminal 41 and the second terminal 42 are electrically connected with the first connecting terminal 31 and the second connecting terminal 32, respectively, without involving an electrically-conductive connecting portion.

Advantages of the first embodiment will be described.

When the actuating motor 10 is attached to the housing 40, the first output terminal 13 and the second output terminal 14 are connected to the first connecting terminal 31 and the second connecting terminal 32, respectively, at the same time. The first output terminal 13 is fitted between the first supporting portion 31*a* and the second supporting portion 31*b*, and the second output terminal 14 is fitted between the first supporting portion 32*b* and the second supporting portion 32*a*. At this time, each of the first supporting portions 31*a*, 32*b* and the second supporting portions 31*b*, 32*a* is elastically deformed.

The clearance between the first supporting portion 31*a* and the second supporting portion 31*b* and the clearance between the second supporting portion 32*a* and the first supporting portion 32*b* are broadened in a width direction. Thus, the first supporting portion 31*a* and the second supporting portion 31*b* elastically and tightly support the first output terminal 13, and the second supporting portion 32*a* and the first supporting portion 32*b* elastically and tightly support the second output terminal 14.

Further, the flexural rigidity of the first supporting portion 31*a*, 32*b* is smaller than the flexural rigidity of the second supporting portion 31*b*, 32*a*. Therefore, the elastic deformation of the first supporting portion 31*a*, 32*b* is larger than that of the second supporting portion 31*b*, 32*a*, such that the distance L1 is secured between the extending portion 12*a* and each of the second supporting portion 31*b* of the first connecting terminal 31 and the second supporting portion 32*a* of the second connecting terminal 32.

Accordingly, the extending portion 12*a* of the motor case 12 is separated enough from each of the second supporting portion 31*b* of the first connecting terminal 31 and the second supporting portion 32*a* of the second connecting terminal 32. By having the distance L1, each of the second supporting portion 31*b* of the first connecting terminal 31 and the second supporting portion 32*a* of the second connecting terminal 32 is restricted from contacting the extending portion 12*a*. That is, the first connecting terminal 31 and the second connecting terminal 32 are restricted from contacting the actuating motor 10. Moreover, as discussed above, the first output terminal 13 and the second output terminal 14 are elastically and tightly supported. Therefore, the first output terminal 13 and the second output terminal 14 are electrically-connected effectively with the first connecting terminal 31 and the second connecting terminal 32, respectively.

The electronic throttle device 1 having the terminal arrangement device 30 actuates the throttle valve S to rotate in the opening direction or in the closing direction. By controlling an opening degree of the throttle valve S, the amount of intake air taken into the engine E is controlled. The ECU G applies the signal, which includes instruction about the required rotation direction for the throttle valve S, to the actuating motor 10. Based on the signal, the actuating motor 10 rotates in the required rotating direction and produces a torque. The torque is transmitted to the throttle valve S via the gear reducer 20, and the throttle valve S is rotated by the torque and is opened with a predetermined opening degree.

The ECU G and the actuating motor 10 are electrically connected with each other via the terminal arrangement device 30. The extending portion 12*a* of the motor case 12 is separated from the second supporting portion 31*b*, 32*a* by the distance L1. Although an impact such as strong vibration is applied to the actuating motor 10 and the terminal arrangement device 30 during an operating time of the engine E, the terminal arrangement device 30 is restricted from contacting the actuating motor 10 due to the distance L1.

Figure 6:
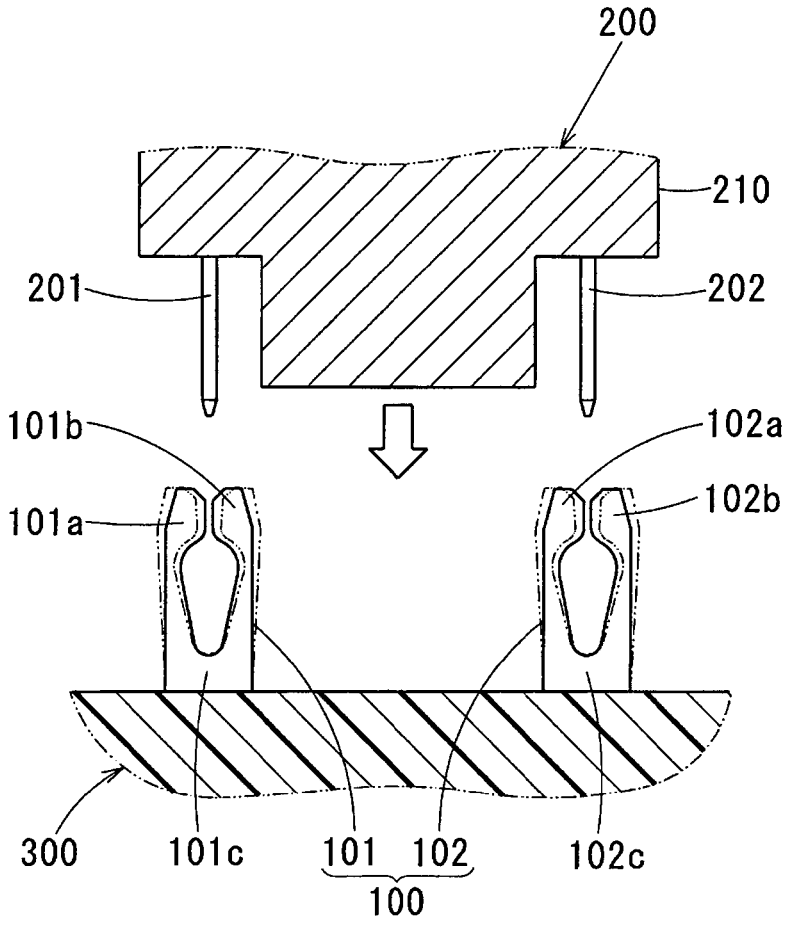
FIG. 6 RELATED ART
FIG. 6 is a schematic cross-sectional view illustrating a terminal arrangement device according to a comparison example.

FIG. 6 illustrates a terminal arrangement device according to a comparison example (related art). As shown in FIG. 6, a terminal arrangement device 100 has a first connecting terminal 101 and a second connecting terminal 102 arranged on a housing 300. The housing 300 has an actuating motor 200 therein. The first connecting terminal 101 has a first supporting portion 101*a* and a second supporting portion 101*b* extending from a base portion 101*c*. The second connecting terminal 102 also has a first supporting portion 102*b* and a second supporting portion 102*a* extending from a base portion 102*c*. An output terminal 201 of the actuating motor 200 is press-fitted into a space defined between the first supporting portion 101*a* and the second supporting portion 101*b*. Therefore, the output terminal 201 is elastically supported between the first supporting portion 101*a* and the second supporting portion 101*b*. An output terminal 202 of the actuating motor 200 is press-fitted into a space defined between the second supporting portion 102*a* and the first supporting portion 102*b*. Therefore, the output terminal 202 is elastically supported between the second supporting portion 102*a* and the first supporting portion 102*b*.

However, in the comparison example, the flexural rigidity of the second supporting portion 101*b*, 102*a* is the same as that of the first supporting portion 101*a*, 102*b*. In this case, an electric circuit of the actuating motor 200 may short out when the connecting terminal 101, 102 is in contact with a case portion 210 of the actuating motor 200.

When the output terminal 201, 202 is press-fitted to the connecting terminal 101, 102, the supporting portion 101*a*, 101*b*, 102*a*, 102*b* is deformed to have a shape shown by a virtual line in FIG. 6. At this time, the second supporting portion 101*b*, 102*a* may contact the case portion 210 of the actuating motor 200. Further, because a space between the case portion 210 and the second supporting portion 101*a*, 102*b* is relatively small, the second supporting portion 101*a*, 102*b* may contact the case portion 210 by vibration while in use.

In contrast, according to the first embodiment, only the first supporting portion 31*a*, 32*b* has large elastic deformation, compared with the second supporting portion 31*b*, 32*a*, when the first output terminal 13 and the second output terminal 14 are elastically supported by the first connecting terminal 31 and the second connecting terminal 32, respectively. Thus, a short circuit is prevented between the terminal arrangement device 30 and the actuating motor 10 by simply adjusting the arrangement and the orientation of the first connecting terminal 31 and the second connecting terminal 32.

Further, the first supporting portion 31*a* and the second supporting portion 31*b* elastically support the first output terminal 13 accurately, and the second supporting portion 32*a* and the first supporting portion 32*b* elastically support the second output terminal 14 accurately. Therefore, electric-connection between the first connecting terminal 31 and the first output terminal 13 and electric-connection between the second connecting terminal 32 and the second output terminal 14 can be secured.

The width B of the second supporting portion 31*b*, 32*a* is made different from the width A of the first supporting portion 31*a*, 32*b* so that the flexural rigidity of the second supporting portion 31*b*, 32*a* is made different from the flexural rigidity of the first supporting portion 31*a*, 32*b*. Therefore, the first supporting portion 31*a*, 32*b* and the second supporting portion 31*b*, 32*a* can be made of one electrically conductive plate having a constant thickness.

According to the first embodiment, the distance L1 between the extending portion 12*a* and the second supporting portion 31*b*, 32*a* can be made as small as possible, so the terminal arrangement device 30 can be made smaller and lighter in weight, and producing cost of the terminal arrangement device 30 can be reduced.

Second Embodiment

A second embodiment will be described with reference to FIGS. 5A-5C.

In the second embodiment, a volume of the first supporting portion 31*a* is made different from a volume of the second supporting portion 31*b*, and a volume of the first supporting portion 32*b* is made different from a volume of the second supporting portion 32*a*, in a different way from the first embodiment.

Figure 5A:
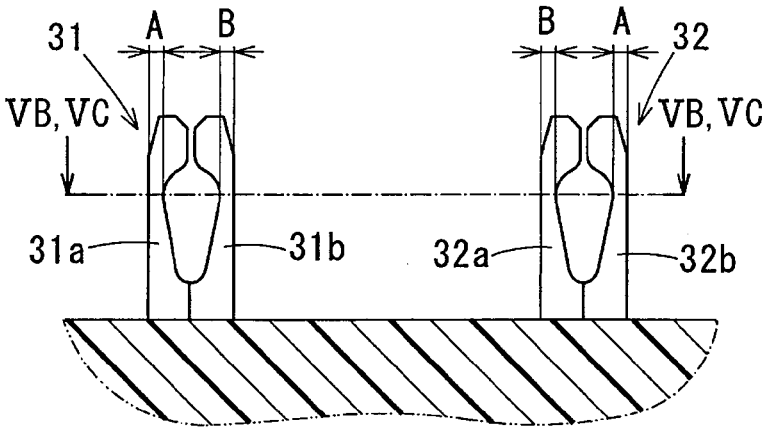
FIG. 5A is a front view illustrating a terminal arrangement device according to a second embodiment.
Figure 5B:
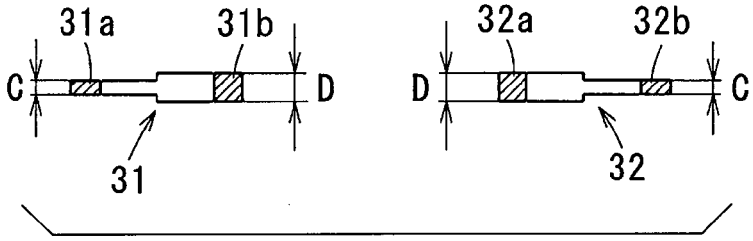
FIG. 5B is a cross-sectional view taken along a line VB-VB in FIG. 5A according to the second embodiment.
Figure 5C:
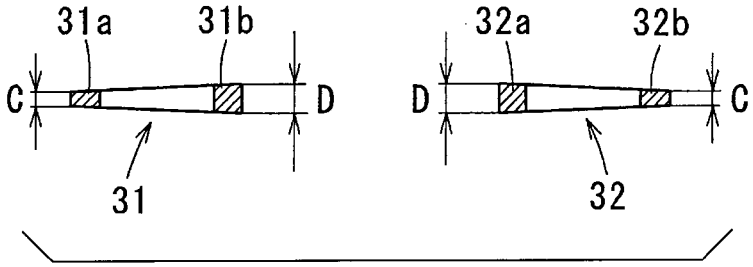
FIG. 5C is a cross-sectional view taken along a line VC-VC in FIG. 5A according to another example of the second embodiment.

As shown in FIGS. 5A and 5B, the width A of the first supporting portion 31*a*, 32*b* is equal to the width B of the second supporting portion 31*b*, 32*a* (i.e., A=B), and a thickness C of the first supporting portion 31*a*, 32*b* is different from a thickness D of the second supporting portion 31*b*, 32*a*. Specifically, the thickness C is smaller than the thickness D (i.e., C<D) so that the flexural rigidity of the second supporting portion 31*b*, 32*a* is larger than the flexural rigidity of the first supporting portion 31*a*, 32*b*.

The first supporting portion 31*a* and the second supporting portion 31*b* elastically and tightly support the first output terminal 13, and the first supporting portion 32*a* and the second supporting portion 32*b* elastically and tightly support the second output terminal 14. The elastic deformation of the first supporting portion 31*a*, 32*b* is larger than that of the second supporting portion 31*b*, 32*a*. Therefore, the distance between the extending portion 12*a* of the motor case 12 and the second supporting portion 31*b*, 32*a* can be reduced to the minimum value. Therefore, the second embodiment produces approximately the same advantages as the first embodiment.

The connecting terminal 31, 32 may be easily produced by pressing-work, to make the thickness C to be different from the thickness D, relative to an electrically conductive plate having a constant thickness. Alternatively, as shown in FIG. 5C, an electrically conductive plate having a tapered shape may be used, in which a thickness of the electrically conductive plate is gradually increased from an end to another end in the width direction of the electrically conductive plate. By using the taper-shaped electrically conductive plate, a thickness of the connecting terminal 31, 32 is increased gradually from the first supporting portion 31*a*, 32*b* to the second supporting portion 31*b*, 32*a*. Thus, the thickness C of the first supporting portion 31*a*, 32*b* can be made smaller than the thickness D of the second supporting portion 31*b*, 32*a*.

Other Modifications

In the above embodiments, the pair of connecting terminals 31 and 32 are arranged such that the actuating motor 10 is placed between the first connecting terminal 31 and the second connecting terminal 32. However, the first connecting terminal 31 and the second connecting terminal 32 are not limited to be used in pair. For example, when the output terminal 14, which is a negative potential terminal, of the actuating motor 10 is grounded via the motor case 12, only the first output terminal 13 is disposed as a positive potential terminal of the actuating motor 10. In this case, only the first connecting terminal 31, which corresponds to the first output terminal 13, is employed, and the flexural rigidity of the second supporting portion 31*b* of the first connecting terminal 31 is set greater than the flexural rigidity of the first supporting portion 31*a* of the first connecting terminal 31.

In the above embodiments, the first terminal 41 and the first connecting terminal 31 are integrally made of one electrically conductive plate, and the second terminal 42 and the second connecting terminal 32 are integrally made of one electrically conductive plate. Alternatively, the first terminal 41 and the first connecting terminal 31 may be produced separately, and the second terminal 42 and the second connecting terminal 32 may be produced separately. In this case, the first connecting terminal 31 and the second connecting terminal 32 may have the same shape and may be arranged to be symmetrical with each other with respect to the actuating motor 10. Specifically, the arrangement may be set symmetrical with respect to a point, by turning one of the same-shaped terminals upside down. Thus, the productivity can be increased.

In the above embodiments, the volume of the first supporting portion 31*a*, 32*b* is different from the volume of the second supporting portion 31*b*, 32*a* to change the flexural rigidity. Alternatively, the flexural rigidity may be changed by changing the shape of the second supporting portion 31*b*, 32*a* located closer to the actuating motor 10 than the first supporting portion 31*a*, 32*b*. Specifically, an edge part of the second supporting portion 31*b*, 32*a* adjacent to the actuating motor 10 is bent at a right angle to extend in the thickness direction of the connecting terminal 31, 32. In this case, the flexural rigidity of the second supporting portion 31*b*, 32*a* can be increased compared with the first supporting portion 31*a*, 32*b*. Accordingly, the flexural rigidity of the first supporting portion 31*a*, 32*b* and/or the flexural rigidity of the second supporting portion 31*b*, 32*a* can be controlled by controlling the width, the thickness, the cross-sectional shape, the elastic modulus or any combination of thereof.

In the above embodiments, the connecting terminal 31, 32 is made of a flat-plate-shaped electrically conductive material having a rectangular shape in cross-section. Alternatively, the electrically conductive material may be a columnar-shaped electrically conductive material having a circular shape in cross-section such as copper bar or aluminum bar. In such a case, the flexural rigidity of the first supporting portion 31*a*, 32*b* and the second supporting portion 31*b*, 32*a* can be adjusted by processing the first supporting portion 31*a*, 32*b* and the second supporting portion 31*b*, 32*a* to have a slit.

The terminal arrangement device 30 can be employed to other electric devices other than the actuating motor 10 of the electronic throttle device 1. The other electric devices are only required to have an electric component and a terminal arrangement device. The electric component is disposed in a housing. The terminal arrangement device electrically connects an output terminal of the electric component to an external device. Further, the other electric devices are not limited to be disposed in a vehicle.

Such changes and modifications are to be understood as being within the scope of the present disclosure as defined by the appended claims.

What is claimed is:

1. A terminal arrangement device that electrically connects an electric device which is received in a housing to an external device, the terminal arrangement device comprising:

a first connecting terminal fixed to the housing, wherein the first connecting terminal has a first supporting portion and a second supporting portion which are elastically deformable such that an output terminal of the electric device is supported between the first supporting portion and the second supporting portion, a thickness direction of the first supporting portion and a thickness direction of the second supporting portion are parallel to each other and are perpendicular to a thickness direction of the output terminal, and the first supporting portion has a flexural rigidity which is different from a flexural rigidity of the second supporting portion.

2. The terminal arrangement device according to claim 1, wherein the second supporting portion of the first connecting terminal is distanced from the electric device by a distance which is shorter than a distance between the electric device and the first supporting portion of the first connecting terminal, and the flexural rigidity of the second supporting portion of the first connecting terminal is larger than the flexural rigidity of the first supporting portion of the first connecting terminal.

3. The terminal arrangement device according to claim 1, wherein the first supporting portion and the second supporting portion of the first connecting terminal are unequal in at least one of a width or a thickness to be unequal in volume such that the flexural rigidity of the second supporting portion of the first connecting terminal is different from the flexural rigidity of the first supporting portion of the first connecting terminal.

4. The terminal arrangement device according to claim 1 further comprising:

a second connecting terminal fixed to the housing, wherein the second connecting terminal has a first supporting portion and a second supporting portion which are elastically deformable such that an output terminal of the electric device is supported between the first supporting portion and the second supporting portion, and the first connecting terminal and the second connecting terminal are arranged such that the electric device is located between the first connecting terminal and the second connecting terminal.

5. The terminal arrangement device according to claim 4, wherein the second supporting portion of the second connecting terminal is distanced from the electric device by a distance which is shorter than a distance between the electric device and the first supporting portion of the second connecting terminal, and the second supporting portion of the second connecting terminal has a flexural rigidity which is larger than a flexural rigidity of the first supporting portion of the second connecting terminal.

6. The terminal arrangement device according to claim 4, wherein the first connecting terminal and the second connecting terminal are the same in shape, and the first connecting terminal and the second connecting terminal are arranged to be symmetrical with each other with respect to the electric device.

7. The terminal arrangement device according to claim 4, wherein the first supporting portion and the second supporting portion of the second connecting terminal are unequal in at least one of a width or a thickness to be unequal in volume such that the flexural rigidity of the second supporting portion of the second connecting terminal is different from the flexural rigidity of the first supporting portion of the second connecting terminal.

8. The terminal arrangement device according to claim 1, wherein the electric device is a motor which actuates a throttle valve for controlling an air amount supplied to an internal combustion engine.

9. The terminal arrangement device according to claim 1, wherein the electric device is an actuating motor having a motor case made of an electrically conducting material, and the second supporting portion is distanced from the motor case by a distance in a state that the output terminal is attached to the first connecting terminal.

10. The terminal arrangement device according to claim 1, wherein the first connecting terminal is produced by insert-molding when the housing is molded.

11. A terminal arrangement device that electrically connects an electric device which is received in a housing to an external device, the terminal arrangement device comprising:

a first connecting terminal fixed to the housing; and a second connecting terminal fixed to the housing, wherein the first connecting terminal has a first supporting portion and a second supporting portion which are elastically deformable such that an output terminal of the electric device is supported between the first supporting portion and the second supporting portion of the first connecting terminal, the second supporting portion of the first connecting terminal has a flexural rigidity which is larger than a flexural rigidity of the first supporting portion of the first connecting terminal, the second supporting portion of the first connecting terminal is distanced from the electric device by a distance which is shorter than a distance between the electric device and the first supporting portion of the first connecting terminal, the second connecting terminal has a first supporting portion and a second supporting portion which are elastically deformable such that an output terminal of the electric device is supported between the first supporting portion and the second supporting portion of the second connecting terminal, the second supporting portion of the second connecting terminal has a flexural rigidity which is larger than a flexural rigidity of the first supporting portion of the second connecting terminal, the second supporting portion of the second connecting terminal is distanced from the electric device by a distance which is shorter than a distance between the electric device and the first supporting portion of the second connecting terminal, and the first connecting terminal and the second connecting terminal are arranged such that the electric device is located between the first connecting terminal and the second connecting terminal.

12. The terminal arrangement device according to claim 11, wherein the first connecting terminal and the second connecting terminal are the same in shape, and the first connecting terminal and the second connecting terminal are arranged to be symmetrical with each other with respect to the electric device.

13. The terminal arrangement device according to claim 11, wherein the first supporting portion and the second supporting portion of the first connecting terminal are unequal in at least one of a width or a thickness to be unequal in volume, and the first supporting portion and the second supporting portion of the second connecting terminal are unequal in at least one of a width or a thickness to be unequal in volume.

14. A terminal arrangement device that electrically connects an electric device which is received in a housing to an external device, the terminal arrangement device comprising:

a first connecting terminal fixed to the housing, wherein the first connecting terminal has a first supporting portion and a second supporting portion which are elastically deformable such that an output terminal of the electric device is supported between the first supporting portion and the second supporting portion, the first supporting portion has a flexural rigidity which is different from a flexural rigidity of the second supporting portion, and the electric device is a motor which actuates a throttle valve for controlling an air amount supplied to an internal combustion engine.

15. The terminal arrangement device according to claim 14, wherein the first supporting portion and the second supporting portion of the first connecting terminal are unequal in at least one of a width or a thickness to be unequal in volume.

16. The terminal arrangement device according to claim 14 further comprising:

a second connecting terminal fixed to the housing, wherein the second connecting terminal has a first supporting portion and a second supporting portion which are elastically deformable such that an output terminal of the electric device is supported between the first supporting portion and the second supporting portion, the first connecting terminal and the second connecting terminal are arranged such that the electric device is located between the first connecting terminal and the second connecting terminal, the first connecting terminal and the second connecting terminal are the same in shape, and the first connecting terminal and the second connecting terminal are arranged to be symmetrical with each other with respect to the electric device.

* * * * *